US009603410B2

(12) United States Patent
McNamara-Schwartz

(10) Patent No.: US 9,603,410 B2
(45) Date of Patent: Mar. 28, 2017

(54) MODULAR SHOE WITH INTERCHANGEABLE COMPONENTS AND METHOD OF ATTACHMENT

(71) Applicant: FLOP GIRL, LLC, Mt. Kisco, NY (US)

(72) Inventor: Kara McNamara-Schwartz, Mt. Kisco, NY (US)

(73) Assignee: Flop Girl, LLC, Mt. Kisco, NY (US)

( * ) Notice: Subject to any disclaimer, the term of this patent is extended or adjusted under 35 U.S.C. 154(b) by 414 days.

(21) Appl. No.: 14/152,071

(22) Filed: Jan. 10, 2014

(65) Prior Publication Data

US 2014/0250725 A1 Sep. 11, 2014

Related U.S. Application Data

(60) Provisional application No. 61/763,977, filed on Feb. 13, 2013.

(51) Int. Cl.

| | |
|---|---|
| ***A43B 3/24*** | (2006.01) |
| ***A43B 21/42*** | (2006.01) |
| ***A43B 23/24*** | (2006.01) |
| ***A43B 3/00*** | (2006.01) |
| ***A43B 3/12*** | (2006.01) |

(52) U.S. Cl.

CPC ..... *A43B 3/242* (2013.01); *A43B 3/0078* (2013.01); *A43B 3/122* (2013.01); *A43B 3/126* (2013.01); *A43B 3/246* (2013.01); *A43B 21/42* (2013.01); *A43B 23/24* (2013.01)

(58) Field of Classification Search

CPC ... A43B 1/0027; A43B 1/0036; A43B 3/0078; A43B 3/246; A43B 21/42; A43B 21/22; A43B 21/52; A43B 21/37; A43B 21/39; A43B 23/24

USPC ..... 36/100, 136, 41, 42, 72 B, 73

See application file for complete search history.

(56) References Cited

U.S. PATENT DOCUMENTS

| | | | | |
|---|---|---|---|---|
| 723,754 | A | 3/1903 | Sullivan et al. | |
| 1,066,305 | A | 7/1913 | Mitchell | |
| 1,230,775 | A | 6/1917 | Popovich | |
| 1,343,602 | A * | 6/1920 | Williams | A43C 13/02 36/41 |
| 1,343,638 | A | 6/1920 | Mitchell | |
| 1,743,543 | A | 1/1930 | Gutierrez | |
| 1,841,027 | A | 1/1932 | Gruber | |
| 1,888,617 | A | 11/1932 | Bridi | |
| 1,903,004 | A * | 3/1933 | Mariani | A43B 3/0078 24/561 |
| 1,955,159 | A | 4/1934 | Winget | |

(Continued)

*Primary Examiner* — Ted Kavanaugh

(74) *Attorney, Agent, or Firm* — Ohlandt, Greeley, Ruggiero & Perle, L.L.P.

(57) ABSTRACT

The modular shoe assembly described herein has removable foot housing straps (a.k.a uppers), and a heel band. This allows a user to customize the shoe in limitless ways, as each of the uppers and heel bands can have any variety of colors, patterns, prints, embossments, or other ornamental decorations such as beads or pearls. When the shoe is a sandal or something, the upper can be removably connected to a toe strap or thong at the front of the shoe assembly and a heel on an underside of the sole. The shoe assembly may also be a ballet shoe, loafer, or similar design, where removably uppers are not needed, and the shoe thus only has a removable heel band.

18 Claims, 19 Drawing Sheets

(56) References Cited

U.S. PATENT DOCUMENTS

| | | | | |
|---|---|---|---|---|
| 1,966,293 | A | 7/1934 | Gillis | |
| 1,994,508 | A | 3/1935 | Filippelli | |
| 1,998,012 | A | 4/1935 | Grant | |
| 2,063,042 | A | 12/1936 | Mauser | |
| 2,076,514 | A * | 4/1937 | Huffman | A43B 21/00 36/34 B |
| 2,109,193 | A | 2/1938 | Field et al. | |
| 2,153,968 | A | 4/1939 | Loufbahn | |
| 2,183,218 | A | 12/1939 | Hewson | |
| 2,233,250 | A | 2/1941 | Easton | |
| 2,252,404 | A | 8/1941 | Mauser | |
| 2,367,232 | A | 1/1945 | Marx | |
| 2,431,868 | A | 12/1947 | Gilmour | |
| 2,461,977 | A * | 2/1949 | Gilmour | A43B 3/0078 24/507 |
| 2,491,297 | A | 12/1949 | Brown | |
| 2,492,013 | A | 12/1949 | Sorofman | |
| 2,582,551 | A | 1/1952 | Malherbe | |
| 2,607,133 | A | 8/1952 | Marlowe | |
| 2,795,867 | A | 6/1957 | Zuckerman et al. | |
| 2,802,285 | A | 8/1957 | Griffin | |
| 2,928,191 | A | 3/1960 | Meltzer | |
| 2,954,618 | A | 10/1960 | Rados | |
| 2,976,623 | A | 3/1961 | Gallaway | |
| 3,192,652 | A | 7/1965 | Melchiorre | |
| 3,318,026 | A | 5/1967 | Antelo | |
| 3,570,147 | A | 3/1971 | Chiu | |
| 3,581,413 | A | 6/1971 | Simonetti | |
| 3,646,497 | A | 2/1972 | Gillikin | |
| 3,925,915 | A | 12/1975 | Colli | |
| 3,983,642 | A | 10/1976 | Liao | |
| 4,115,933 | A | 9/1978 | Chiaramonte, Jr. | |
| 4,214,384 | A | 7/1980 | Gonzalez | |
| 4,297,798 | A | 11/1981 | Colan | |
| 4,450,633 | A | 5/1984 | Connelly | |
| 4,461,102 | A | 7/1984 | DeVincentis | |
| 4,756,097 | A | 7/1988 | Sanders | |
| 4,887,369 | A | 12/1989 | Bailey et al. | |
| 5,025,574 | A | 6/1991 | Lasher, III | |
| 5,052,129 | A | 10/1991 | Lobasso et al. | |
| 5,311,676 | A | 5/1994 | Hughes et al. | |
| 5,347,730 | A | 9/1994 | Rodriguez Colon | |
| 5,373,649 | A | 12/1994 | Choi | |
| 5,419,060 | A | 5/1995 | Choi | |
| 5,519,950 | A | 5/1996 | Wang | |
| D378,548 | S | 3/1997 | Harmon, II | |
| D384,495 | S | 10/1997 | Watson | |
| 5,692,322 | A | 12/1997 | Lombardino | |
| 5,992,058 | A | 11/1999 | Jneid | |
| 6,848,199 | B1 | 2/2005 | Giannelli | |
| 7,243,443 | B2 | 7/2007 | Swigart | |
| 7,272,899 | B1 | 9/2007 | Marak | |
| 7,562,468 | B2 | 7/2009 | Ellis, III | |
| 7,650,704 | B2 | 1/2010 | Richardson | |
| D630,826 | S | 1/2011 | Boyer | |
| 7,866,062 | B2 | 1/2011 | Yang | |
| D639,537 | S | 6/2011 | Countee et al. | |
| 7,954,256 | B2 | 6/2011 | Colella | |
| 7,954,260 | B2 | 6/2011 | Enderson | |
| 8,015,731 | B2 | 9/2011 | Jackson | |
| 8,020,319 | B1 | 9/2011 | Mohaupt | |
| 8,112,906 | B2 | 2/2012 | Paik | |
| 8,141,275 | B1 | 3/2012 | Donaldson et al. | |
| 8,151,491 | B2 | 4/2012 | Sarantakos | |
| D664,747 | S | 8/2012 | Ma | |
| 8,307,571 | B1 | 11/2012 | Ceylan | |
| 8,434,246 | B2 | 5/2013 | Enderson | |
| 8,448,351 | B2 | 5/2013 | Aveni | |
| 8,839,529 | B1 | 9/2014 | Levy | |
| 8,914,992 | B1 | 12/2014 | Kaufman et al. | |
| 9,015,963 | B1 | 4/2015 | Dominguez | |
| 9,032,644 | B1 | 5/2015 | Koo et al. | |
| 2008/0235993 | A1 | 10/2008 | Wegner | |
| 2009/0038181 | A1 | 2/2009 | Loughnane | |
| 2009/0241319 | A1 | 10/2009 | Kilgore et al. | |
| 2010/0000126 | A1 | 1/2010 | Ortner | |
| 2010/0018076 | A1 | 1/2010 | Buck | |
| 2010/0186258 | A1 | 7/2010 | Garza | |
| 2011/0197474 | A1 | 8/2011 | Mahmoud | |
| 2011/0283564 | A1 | 11/2011 | Stillwagon | |
| 2012/0137543 | A1 | 6/2012 | Kemp | |
| 2012/0186105 | A1 | 7/2012 | Kemp et al. | |
| 2012/0204359 | A1 | 8/2012 | Adami et al. | |
| 2012/0216429 | A1 | 8/2012 | Bastida et al. | |
| 2012/0227289 | A1 | 9/2012 | Beers et al. | |
| 2012/0233890 | A1 | 9/2012 | Masters | |
| 2013/0019496 | A1 | 1/2013 | Mizrahi-Shapiro | |
| 2013/0067770 | A1 | 3/2013 | Sherwood et al. | |
| 2013/0091732 | A1 | 4/2013 | Mendoza | |
| 2013/0091736 | A1 | 4/2013 | Worley | |
| 2013/0097893 | A1 | 4/2013 | Rabinovitch | |
| 2013/0206619 | A1 | 8/2013 | Angiulo et al. | |
| 2013/0306501 | A1 | 11/2013 | Angiulo et al. | |
| 2013/0312285 | A1 | 11/2013 | Sharma et al. | |
| 2013/0318827 | A1 | 12/2013 | Ringholz | |
| 2013/0340285 | A1 | 12/2013 | Blowers | |
| 2013/0340286 | A1 | 12/2013 | Schindler | |
| 2014/0000126 | A1 | 1/2014 | Nelson-Warren | |
| 2014/0007458 | A1 | 1/2014 | Berger et al. | |
| 2014/0013621 | A1 | 1/2014 | Dupree et al. | |
| 2014/0075783 | A1 | 3/2014 | Licht | |
| 2014/0075787 | A1 | 3/2014 | Cartagena | |
| 2014/0096413 | A1 | 4/2014 | Anderson | |
| 2014/0137436 | A1 | 5/2014 | Saccullo et al. | |
| 2014/0230286 | A1 | 8/2014 | Paugh et al. | |
| 2014/0259777 | A1 | 9/2014 | Morris Thill | |
| 2014/0259778 | A1 | 9/2014 | Anderson | |
| 2014/0259779 | A1 | 9/2014 | Hashish et al. | |
| 2014/0298684 | A1 | 10/2014 | Young | |
| 2014/0298685 | A1 | 10/2014 | Alan et al. | |
| 2014/0305007 | A1 | 10/2014 | Skaggs et al. | |
| 2014/0317961 | A1 | 10/2014 | Mathis | |
| 2014/0352171 | A1 | 12/2014 | Hillyer | |
| 2015/0020414 | A1 | 1/2015 | Mulholland | |
| 2015/0101210 | A1 | 4/2015 | Jang | |
| 2015/0143719 | A1 | 5/2015 | Fosbrook | |

* cited by examiner

FIG

MODULAR SHOE WITH INTERCHANGEABLE COMPONENTS AND METHOD OF ATTACHMENT

CROSS-REFERENCE TO RELATED APPLICATIONS

The present application claims priority to U.S. Provisional Patent Application No. 61/763,977, filed on Feb. 13, 2013, which is herein incorporated by reference.

BACKGROUND OF THE DISCLOSURE

1. Field of the Disclosure

The present disclosure relates generally to footwear and more particularly to a 1) shoe with removable heel sections to change heel décor and a 2) convertible shoe with removable heel section(s) to change the décor as well as convert the uppers (straps) to various types of straps and strap layouts. The removable heel sections can have varying designs and appearances. Straps can be configured as thongs, sling backs, modulated over the arch straps (e.g., with the addition of a tee strap) to secure to the sole. The straps can also be configured as an arch strap that can wrap around the ankle.

2. Description of the Related Art

Footwear, such as shoes, boots, and sandals are typically purchased in a finished state. Thus, no further customization is typically available after purchase, other than permanent defacing, or otherwise personal customization by the user. Recently, customizable shoes and sandals have been provided, allowing for the user to make decorative changes to these items after purchase. Such modifications have generally been limited to the affixing of ornamental features to existing structural features of such footwear. There is a need for a shoe design with enhanced flexibility in adjusting structural features.

SUMMARY OF THE DISCLOSURE

The present disclosure has determined that the various shoes previously described fail to meet all desired customization requirements of a preferred shoe. Various embodiment of the present invention may include one or more of the following features. First, a one piece sole is provided for the shoe. The sole can comprise one or more holes for a toe strap, for example between the big toe and second toe. The sole can be provided with an attached partial, routed heel with base. This allows for modular, decorative heel sections to be attached to change the heel decoration and complete the heel for wearing. The heel decoration will be manufactured in a number of various designs, including, but not limited to beads, pearls, ribbon, single or multiple strands of cording, or the like. The heel decoration can take shape in any heel size (height, width, circumference) as well as shoe heel style (flat, pump, wedge, spike, or others).

A toe strap is preferably provided as a separate, one piece strap with attached buckle. It is connected to an anchor, which keeps the toe strap held in place to the shoe sole. The strap may be coupled to a foot housing strap (i.e. an upper), as will be described below, thus allowing for various combinations of toe straps and foot housing straps to be selected by a user. The top of the toe strap can be formed with a buckle in which to receive a closure element included with a foot housing strap, as will be described below.

In one embodiment of the disclosure, a portion of the toe strap to be positioned below the sole, namely the anchor, may be provided with a custom or ornamental design. The design of the toe strap may impart its shape along sand, soft ground or other walking surfaces. One such design may include a heart, with or without a criss-cross pattern on its face.

The foot housing strap may be formed of beads, pearls, ribbon, single or multiple strands of cording, or the like, which would form the structural elements thereof. The beads, etc. may also be attached to a strip or leather or other suitable material, the latter of which would serve as the structural component of the foot housing strap. The upper strap of the present disclosure thus may have both structural and ornamental aspects or features. The foot housing straps can couple to the described sole at two or more locations: 1) the toe strap; 2) the inventive heel clasp, facing forward at the underside of the sole; 3) an extension of the upper straps allowing closure around the ankle or similar area. The foot housing straps are preferably interchangeable with the heel mechanism and toe strap.

As noted above, an interchangeable heel band may also be provided. The heel band can be coupled to, and decoupled from, the heel, in the manner described below. Colors, textures, materials and shapes of one or more heel ornamentations may be changed to provide a variety of selections to be chosen by a user.

In additional embodiments, a heel strap may further be provided integral with the heel, may be provided to be connected to another portion of the foot housing strap, or the heel may be provided with heel anchor straps similar to the left and right side straps included with the main portion of the sole designed to be coupled with the upper strap. These heel anchor straps are adapted to be coupled with the optional heel strap and may preferably be removed or hidden when not in use.

On the top-side of the sole, interchangeable arch, heel, and "ball of the foot" pads may be provided, allowing for the choice of a number of designs, fabrics, trims and colors.

Still other objects and advantages of the invention will in part be obvious and will in part be apparent from the specification and drawings.

DETAILED DESCRIPTION OF THE DISCLOSURE

Figure 1:
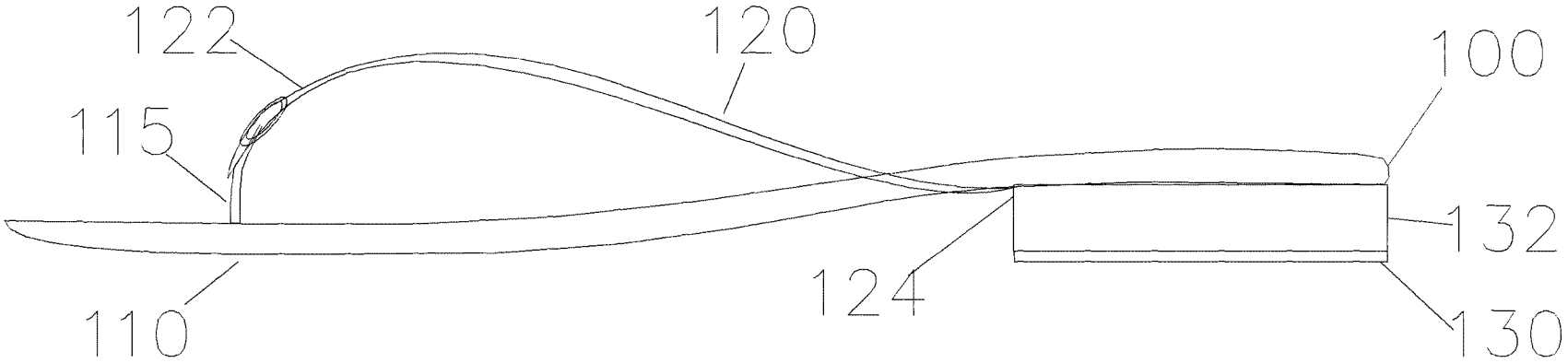
FIG. 1 shows a side plan view of a first embodiment of the show of the present disclosure.
Figure 2B:
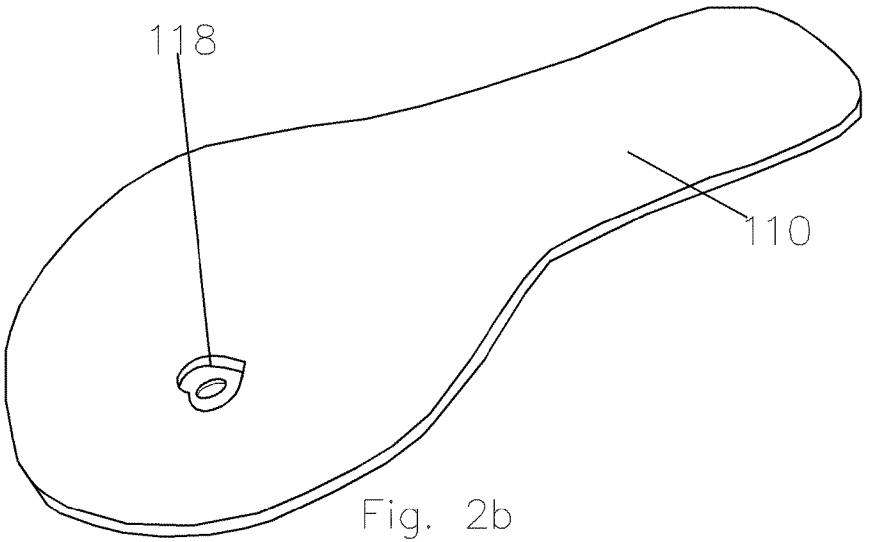
FIG. 2*b* shows a bottom view of a sole of the shoe of FIG. 1.
Figure 2A:
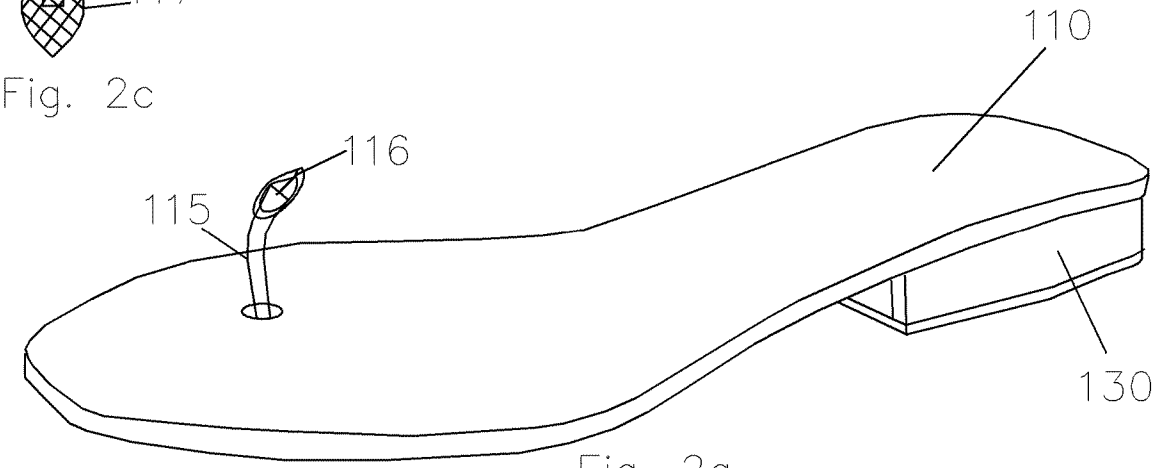
FIG. 2*a* shows a top, perspective view of the shoe of FIG. 1, with the foot housing strap removed.
Figure 2C:
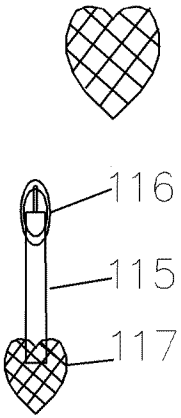
FIG. 2*c* shows a view of the toe strap of the shoe of FIG. 1.
Figure 2D:
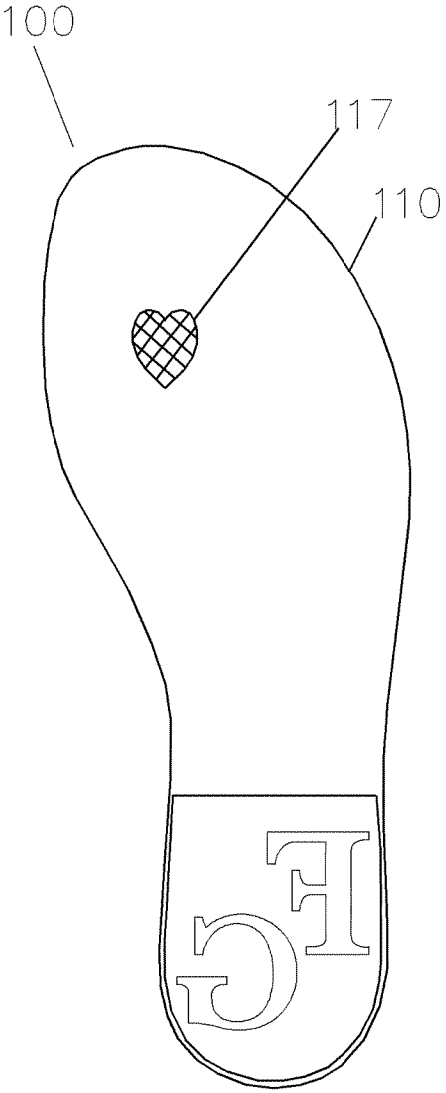
FIG. 2*d* shows a bottom view of the shoe of FIG. 1.
Figure 3:
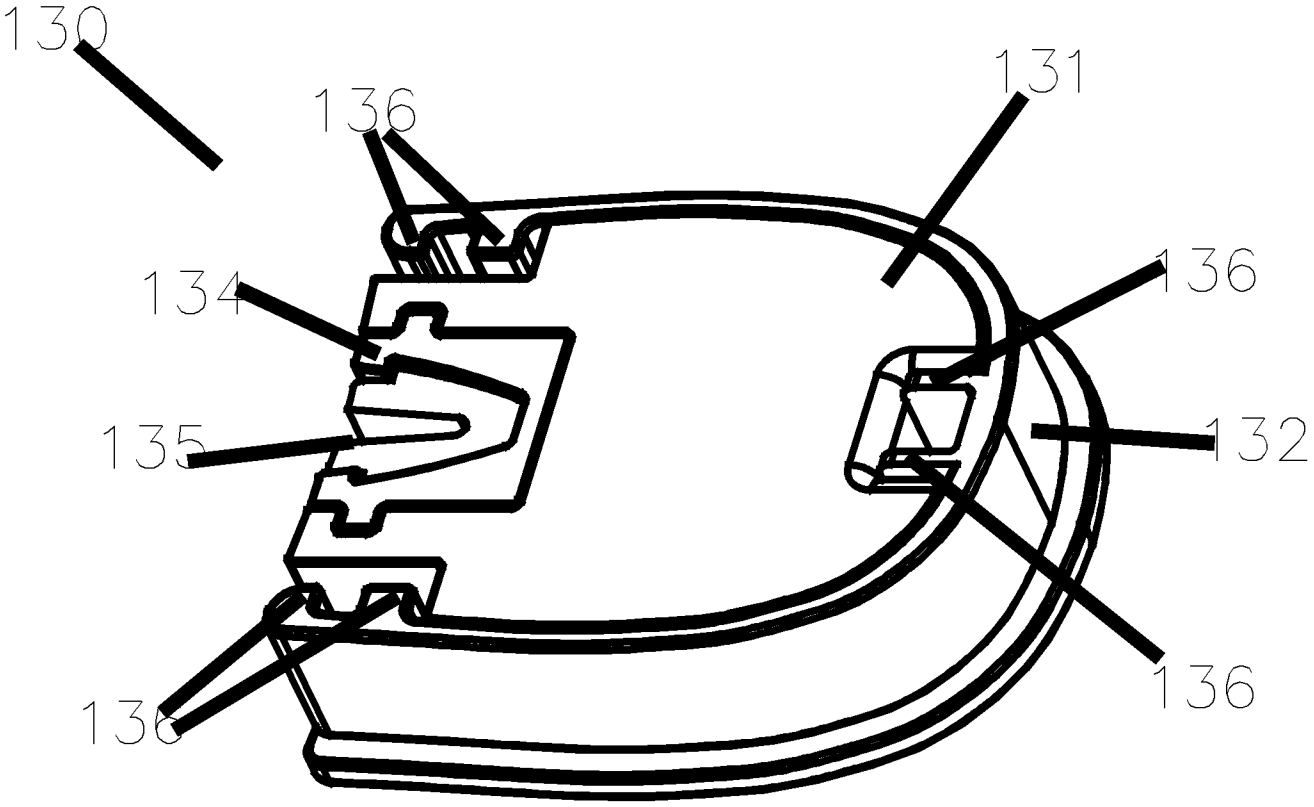
FIG. 3 shows a bottom, perspective view of the assembled heel of the shoe of FIG. 1.

Referring to the drawings, and in particular FIGS. 1-7*d*, a first embodiment of shoe 100 of the present disclosure is shown. Shoe 100 has sole 110, toe prong 115, foot housing strap 120, and heel 130. Foot housing strap 120 is removably connected to toe prong 115 and heel 130, the latter on an underside of sole 110. Heel 130 has a removably connected band 132 that fits around a circumference thereof. As discussed in greater detail below, with shoe 100, a user can very easily swap out different structural features and ornamental designs to their liking by utilizing different foot housing straps 120 and/or bands 132. This arrangement provides significant advantages over currently available shoe designs. In most current shoes, the structural and ornamental aspects of the shoe are fixed upon manufacture, and the user has no option to customize other than permanent alteration or defacement. With shoe 100, by simply connecting and disconnecting foot housing strap 120 and/or heel band 132, the user has limitless options for their footwear.

In the present disclosure, unless otherwise specified, the term "shoe" describes any footwear for a user. This includes sandals, boots, open- or closed-toe designs, ballet shoes, loafers, or other designs. The "front" of a shoe is the area where a user's toes would be located, and the "rear" is where the user's heel is located when they are wearing shoe 100. A "top" orientation aligns with the top of the user's feet, and the "bottom" direction is the bottom of the user's foot, the sole 110 of shoe 100, or on the bottom of sole 110. For ease of description, "upper" is used synonymously with the term "foot housing strap".

Foot housing strap or upper 120 is removably connected to toe prong 115 via buckle 116 on toe prong 115. A buckle end 122 of upper 120 has puncture holes that mates with the prong and frame of buckle 116. This is a very easy and convenient method for removing and connecting upper 120 to toe strap 115. Although in the shown embodiments toe prong 115 is connected to upper 120 with a buckle, the present disclosure contemplates other connection methods between the two, such as but not limited to a hook-and-loop fastener (e.g., Velcro®), or a button and hole (discussed below).

Toe strap 115 has an anchor 117, which retains toe prong 115 within a hole 118 of sole 110. In one embodiment, toe prong anchor 117 can have an ornamental shape, such as the shown heart, but any shape or texture may be provided. Anchor 117 may also be removably connected to toe strap 115, to provide different designs. Hole 118 can have a corresponding shape to anchor 117. Toe strap 115 can be permanently connected to sole 110 through hole 118, or may be removably connected thereto as well.

Figure 4:
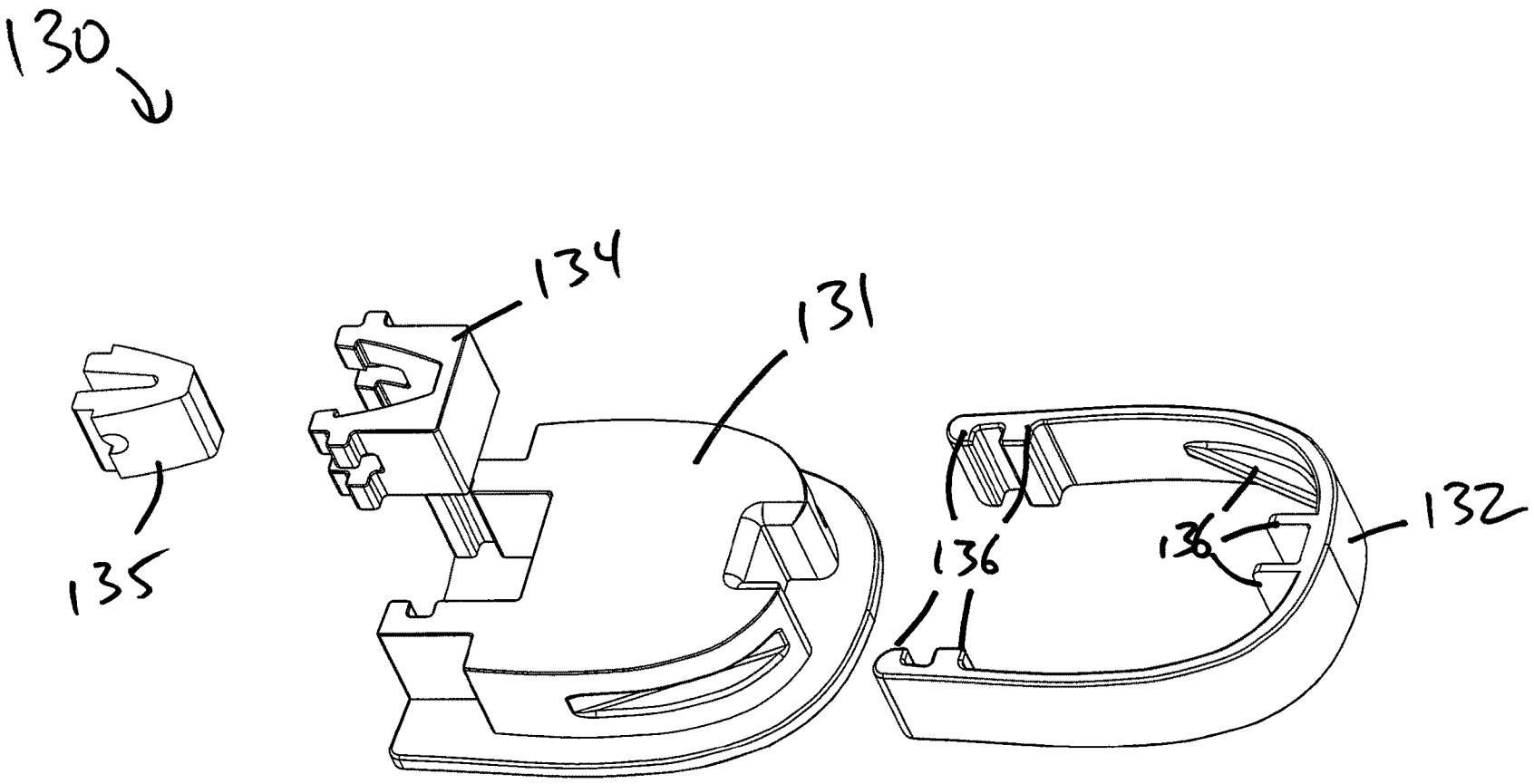
FIG. 4 shows a first exploded view of the heel of FIG. 3.
Figure 4A:
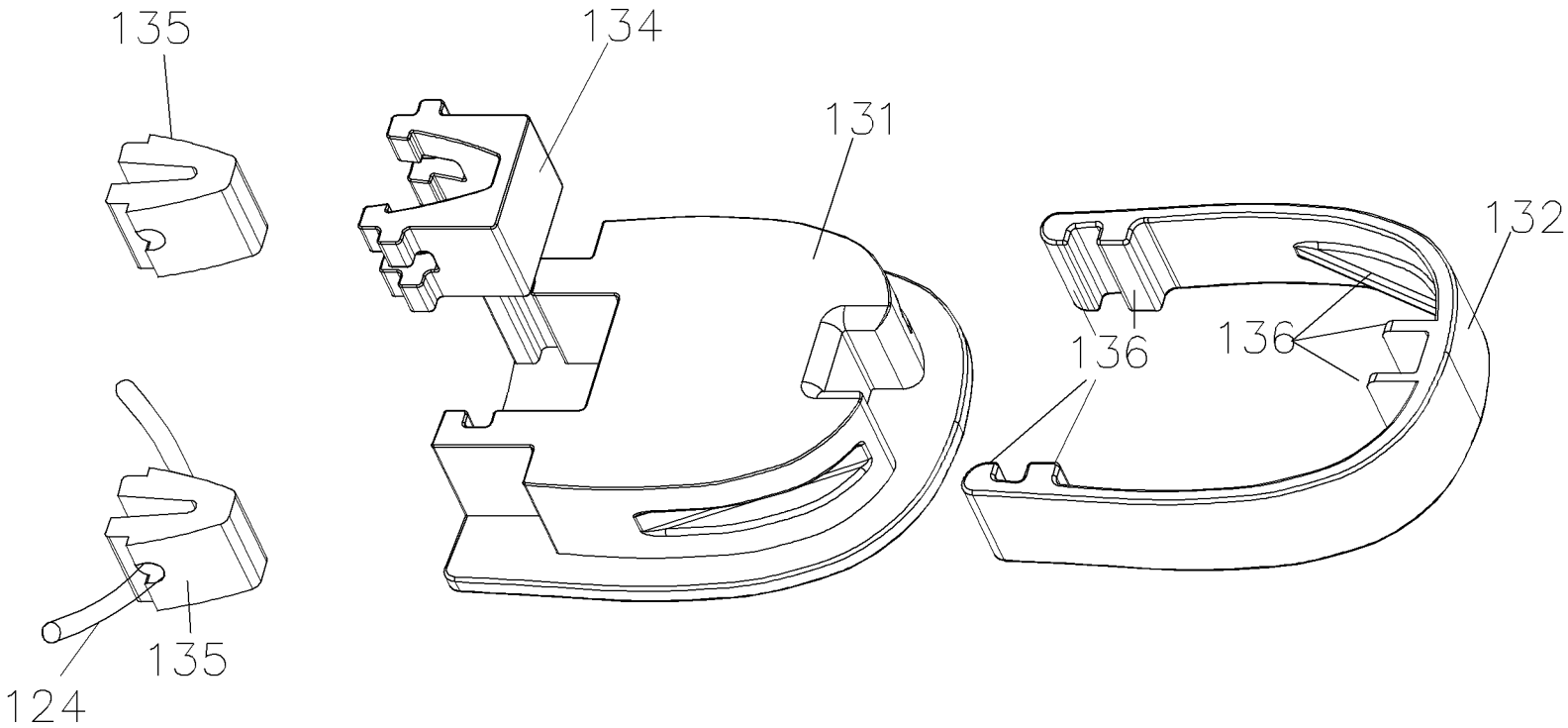
FIG. 4*a* shows a second exploded view of the heel of FIG. 3, with a section of the foot housing strap connected thereto.
Figure 5:
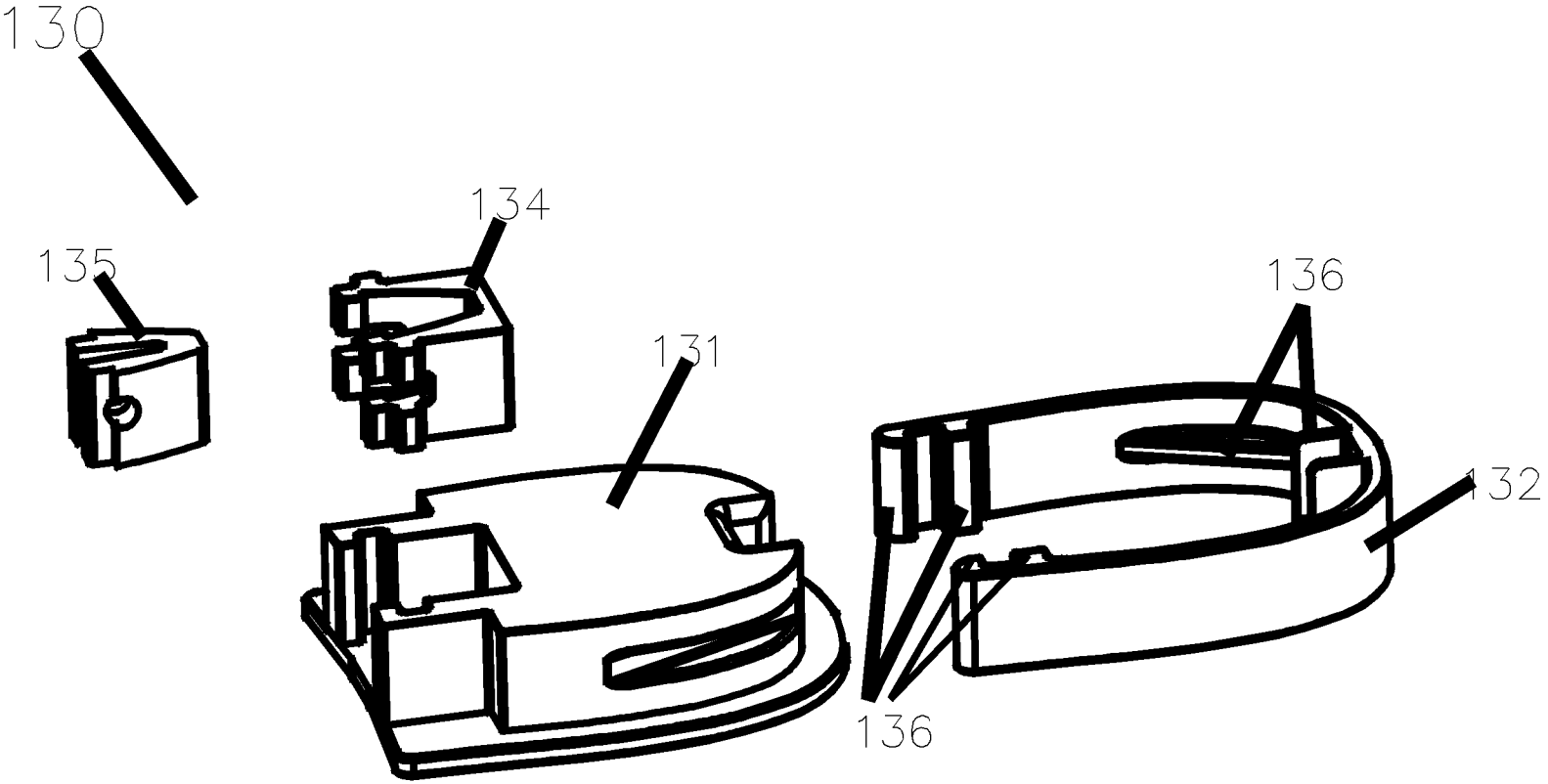
FIG. 5 shows a third exploded view of the heel of FIG. 3.
Figure 6:
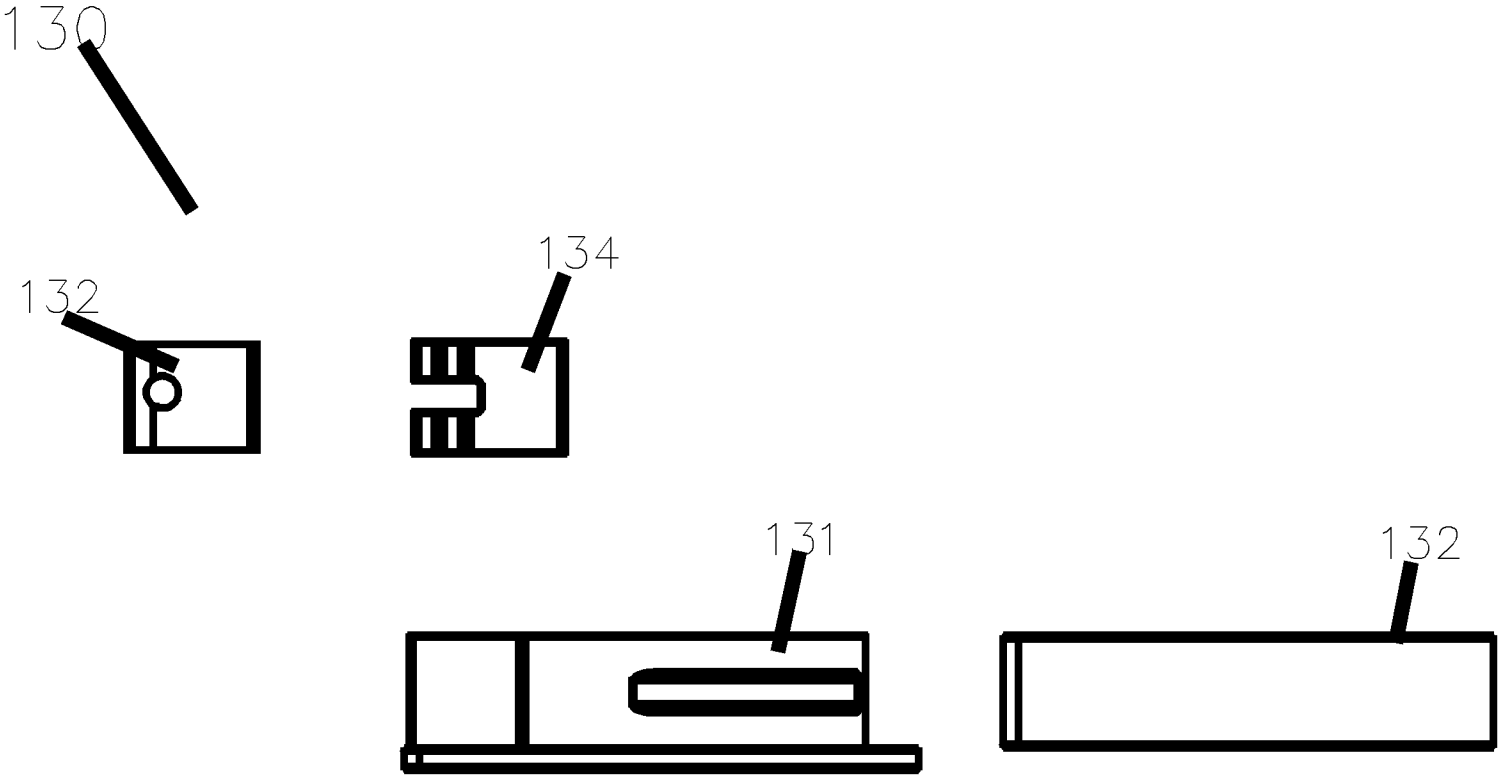
FIG. 6 shows a third exploded view of the heel of FIG. 3.
Figure 7A:
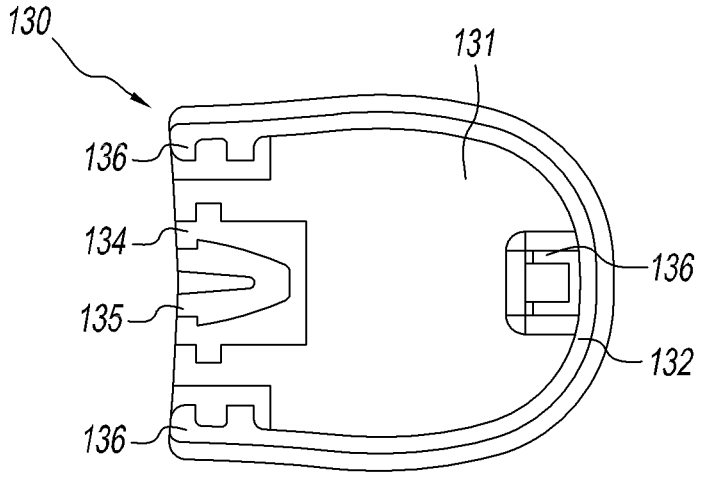
FIG. 7*a* shows a side elevation view of the heel of FIG. 3.
Figure 7B:
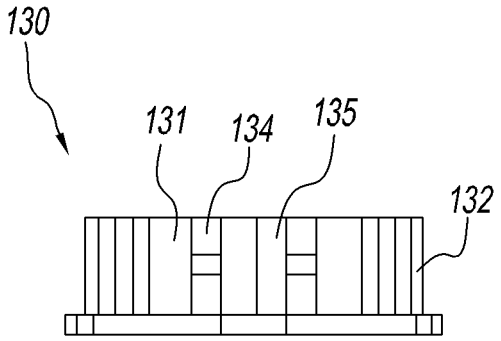
FIG. 7*b* shows a front elevation view of the heel of FIG. 3.
Figure 7C:
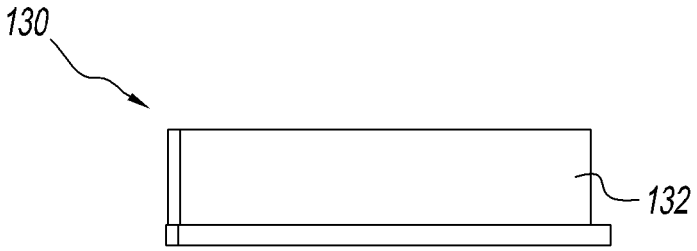
FIG. 7*c* shows a bottom view of the heel of FIG. 3.
Figure 7D:
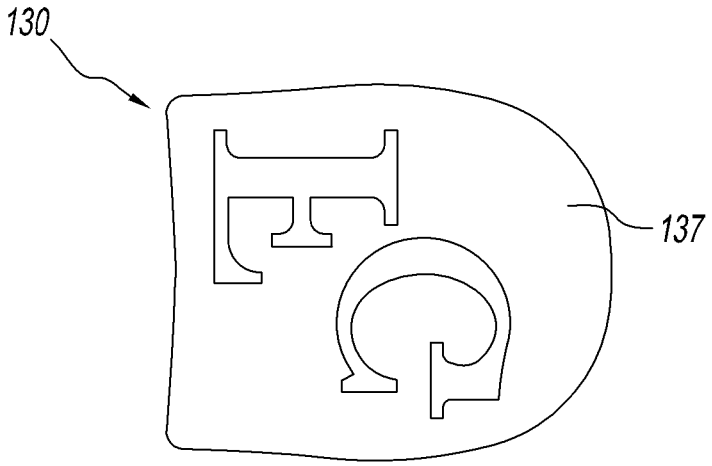
FIG. 7*d* shows a bottom view of the heel of FIG. 3, with a covering thereon.

Referring specifically to FIGS. 3-7*d*, details of heel 130 are shown. Heel 130 has base 131, band 132, latch 134, and clasp 135. Clasp 135 fits within latch 134, and the two components together fit within a notch cut in a front portion of base 131. To secure upper 120 to heel 130, the user takes a heel end 124 of upper 120, and places it in the space between clasp 135 and latch 134, so that end 124 is threaded through clasp 135, as shown in FIG. 4*a*. Other methods of connecting upper 120 to clasp 135 and heel 130 are contemplated, for example by wrapping end 124 around clasp 135 and placing the two into latch 134, ensuring a pressure- or friction-fit.

Clasp 135 has a u-shape, as shown, so that it is biased into an open position, but is flexible, so that the ends can be squeezed toward one another. When the user places clasp 135 within latch 134, the bias of clasp 135 ensures that there is a tight fit between all of the components. To remove clasp 135 and substitute a different upper 120, the user simply has to squeeze on the ends of clasp 135, with the aid of end 124 of upper 120, to remove clasp 135. Latch 134 can be removably or permanently connected to base 131 of heel 130.

As previously discussed, band 132 can fit around an exterior lateral circumference of base 131 of heel 130. In the shown embodiment, band 132 is horseshoe-shaped, but other shapes are contemplated by the present disclosure, such as rectangular or with squared-off corners.

The exterior surface of band 132 can have an ornamental design, which can include and variety or number of colors, patterns, textures, embossments, or the like. Band 132 can also have decorative objects on its exterior surface, for example stones or beads. This provides yet another easily customizable feature of shoe 100 for the user. As discussed below, band 132 can be easily connected to and removed from base 131 of heel 130.

Band 132 can have a number of ribs 136 at ends thereof, or projecting out from an interior surface thereof. Some of ribs 136 can be at the rear of band 136, and can fit into a notch in the rear end of base 131. Ribs 136 at the front ends of band 132 snap fit around an edge of base 131, to secure band 132 in place. The user removes band 132 simply by moving ribs 136 around base 131. A heel tread 137 can fit over base 131, band 132, latch 134, and clasp 135, to help secure them all in place and protect heel 130 from the ground when shoe 100 is in use. Heel tread 137 can have a logo or other printed material thereon. Heel tread 137 can be either permanently or removably connected to base 131 or the other components of heel 130.

Figures 8A, 8B, 8C, 8D, 8E:
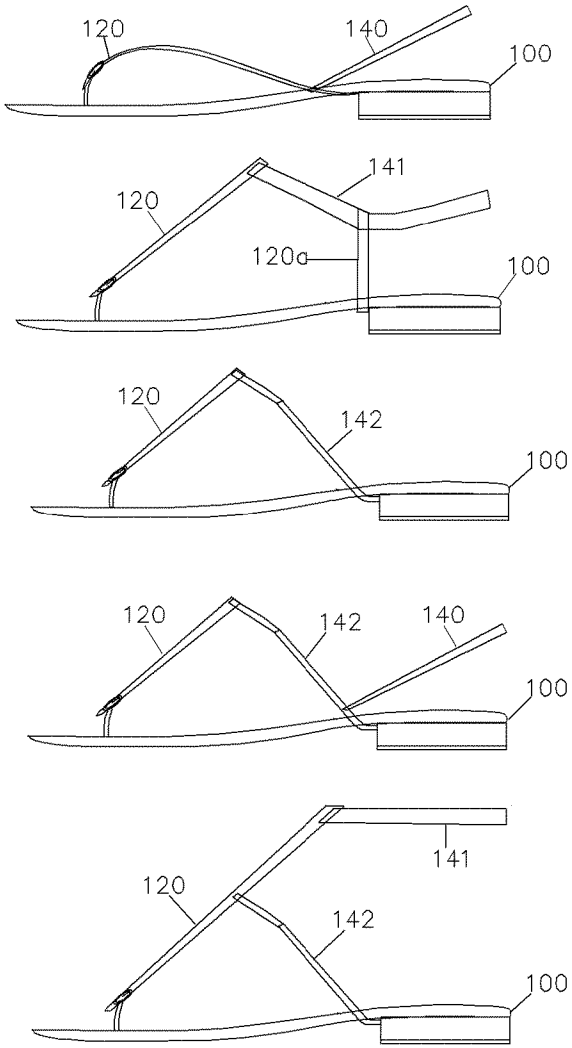
FIGS. 8*a*-8*e* show alternative designs of the shoe of FIG. 1, with additional and differently shaped straps.
Figures 9A, 9B:
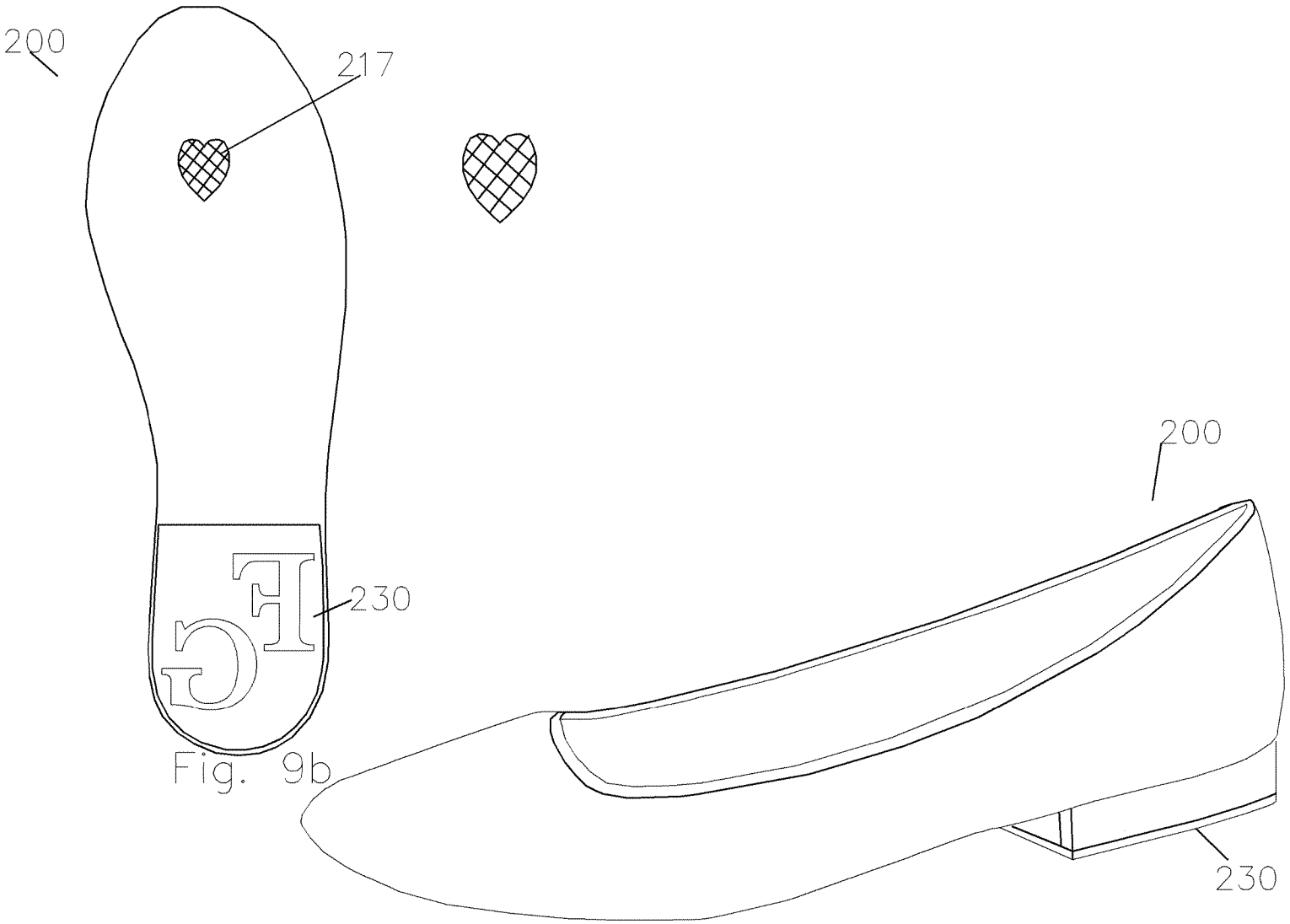
FIG. 9*a* shows a top, perspective view of a second embodiment of the shoe of the present disclosure.
FIG. 9*b* shows a bottom view of the shoe of FIG. 9*a;*
Figure 10:
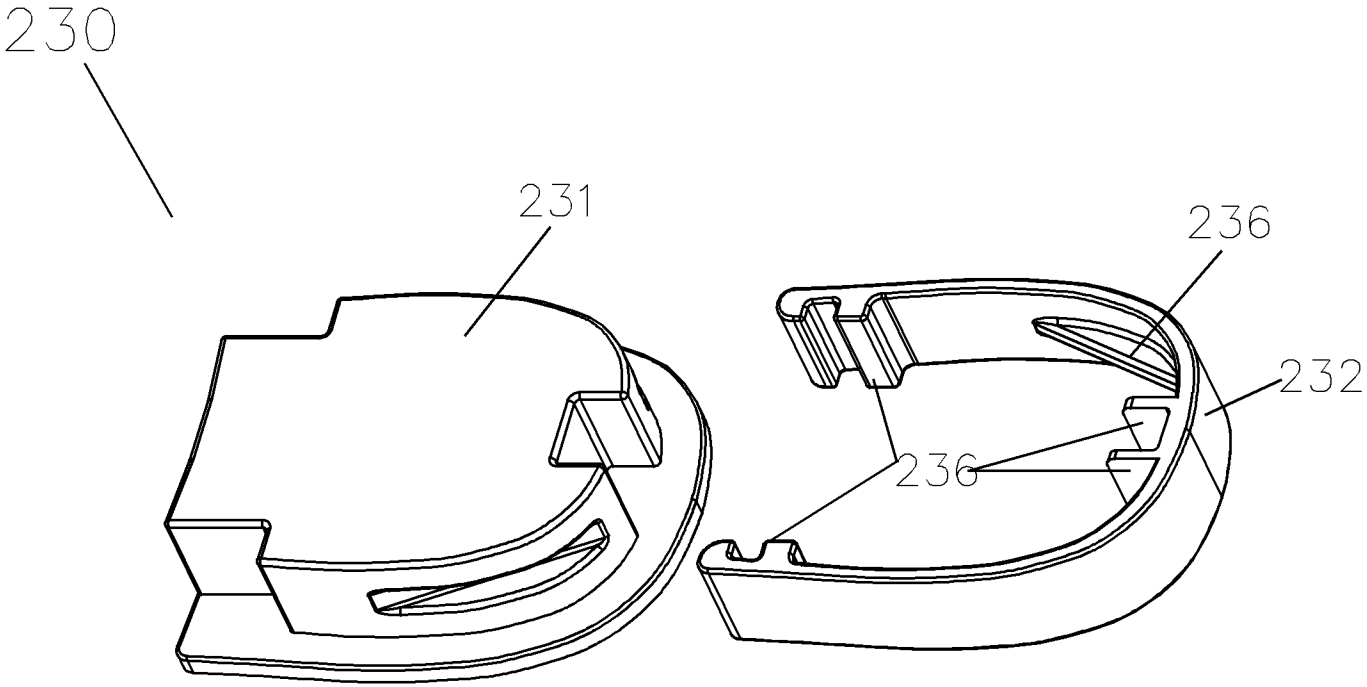
FIG. 10 shows an exploded view of the heel of the shoe of FIG. 9*a;*
Figure 10B:
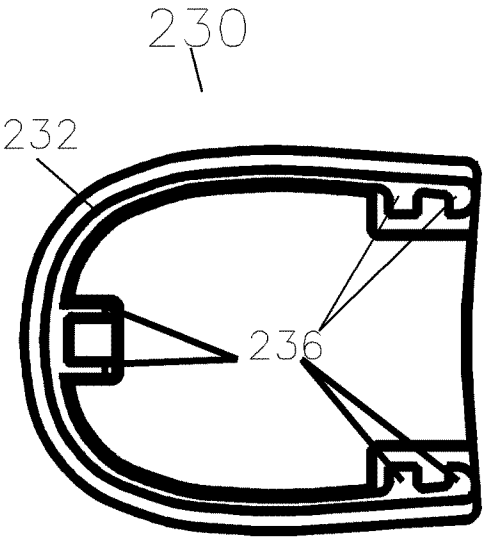
FIG. 10*b* shows a bottom view of the heel of FIG. 10.
Figure 10A:
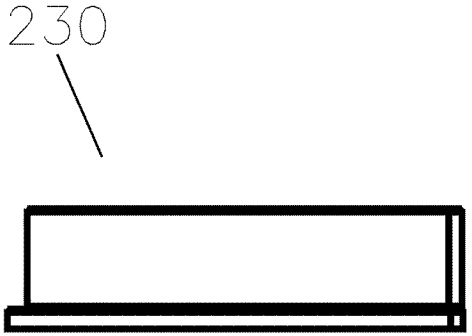
FIG. 10*a* shows a side elevation view of the heel of FIG. 10.
Figure 10C:
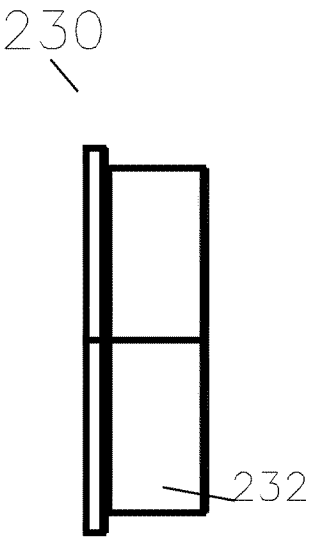
FIG. 10*c* shows a rear elevation view of the heel of FIG. 10.
Figure 10D:
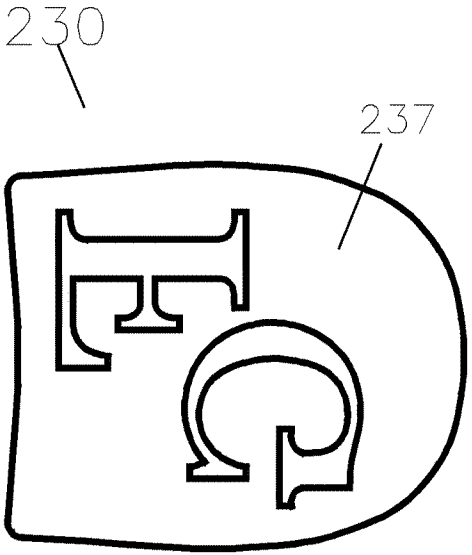
FIG. 10*d* shows a bottom view of the heel of FIG. 10, with a covering thereon.

Referring to FIGS. 8*a*-8*e*, alternative embodiments of shoe 100 are shown. In FIG. 8*a*, shoe 100 has an additional heel strap 140 that can connect to upper 120. In FIG. 8*b*, shoe 100 further comprises full ankle strap 141 and a second upper 120*a*. In this embodiment, upper 120 connects to heel strap 140, which is in turn connected to second foot strap 142. The embodiment of FIG. 8*c* shows upper 120 connected to arch strap 142. FIG. 8*d* has upper 120 connected to arch strap 142, which is in turn connected to heel strap 140. In the embodiment of FIG. 8*e*, upper 120 is connected to both arch strap 142 and an ankle strap 141.

The embodiments of FIGS. 8*a*-8*e* show various arrangements of heel straps 140, second foot straps 142, and ankle straps 144. The present disclosure contemplates any arrangements of upper 120, heel strap 140, second foot straps 142, and ankle straps 144 to secure the user's foot to shoe 100. Any one of these can also be connected to heel 130 in the manner described above with upper 120. In addition, each of upper 120, second foot strap 140, heel straps 142, and ankle straps can be connected to one another with buckles or other suitable connection methods.

Sole 110 can be made with any number of suitable processes, such as by hand, machine fabrication, or injection molded. Sole 110 can be a unitary element, but may also have a non-unitary construction, with two or more separate parts connected to each other.

The materials in shoe 100 can be any suitable for use as described above, and as with sole 110, can be hand-made, fabricated by machine, or injection molded. Examples include wood, cork, leather, plastic, or combinations thereof. The materials of uppers 120 and any of the straps 140, 142, and 144 can be, for example, leather or ribbon. They can be studded with decorative materials such as beads, pearls, stones, or gems, or these decorative materials may comprise the straps themselves (e.g., a string of pearls). Heel 130 and band 132 can be made of materials such as, but not limited to, wood, cork, leather, silicone, urethane, ethylene vinyl acetate, and/or clear polymers.

Referring to FIGS. 9*a*-10*d*, a second embodiment of the shoe of the present disclosure is shown, and referred to by reference number 200. Shoe 200 is a closed-toe shoe, and therefore does not utilize uppers 120 as in shoe 100. Shoe 200 has heel 230, which has band 232. Similarly to band 132 of shoe 100, band 232 of shoe 200 can be removable connected to a rear end of heel 130. This allows a user to customize shoe 200 with various decorations and appearances. Similarly to band 132, band 232 can have a number of ribs 236 to help keep band 232 in place. Shoe 200 can also have a logo or other text on a heel tread 237 of heel 230, or have a decorative element 217 recessed into sole 210.

Figures 11A, 11B:
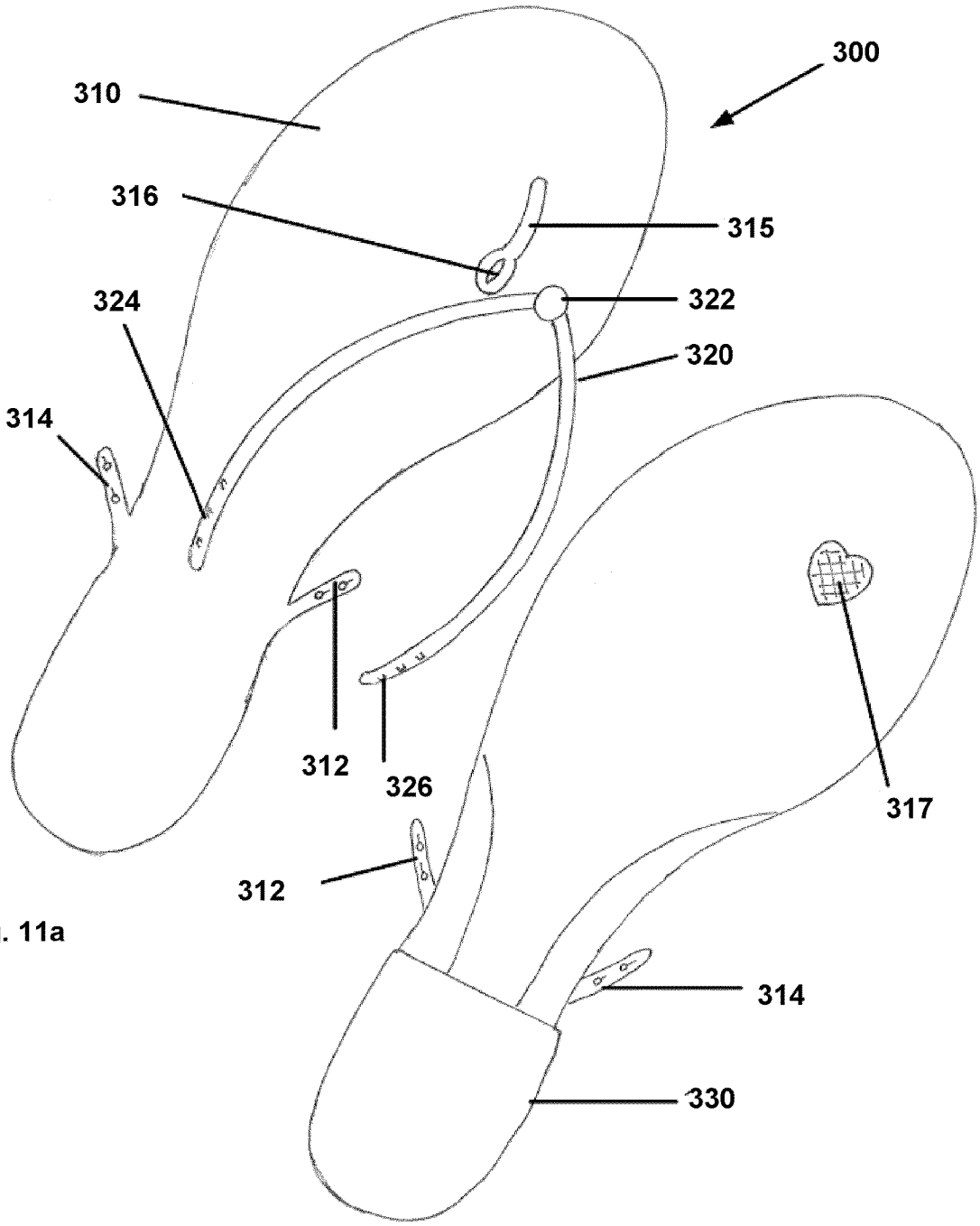
FIG. 11*a* shows a top view of a third embodiment of a shoe of the present disclosure.
FIG. 11*b* shows a bottom view of the shoe of FIG. 11*a;*

Referring to FIGS. 11*a* and 11*b*, a third embodiment of the shoe of the present disclosure is shown. Shoe 300 functions in a similar manner to shoe 100, with the differences described below.

Shoe 300 is shown with a sole 310. Shoe 310 further comprises right and left side anchor straps 312, 314. Also shown is a toe prong 315 with a toe prong coupler 316. A foot housing strap 320 is adapted to be coupled with shoe 300, and further comprises foot housing strap coupler 322 adapted to be coupled with toe prong coupler 316. As discussed in greater detail below, one difference between shoe 300 and shoe 100 is that in the former, foot housing strap is connected to toe prong 315 by placing coupler 322 into coupler 316, with a button-and-hole type of connection (as opposed to the buckle of shoe 100).

Right and left foot housing strap anchors 326, 324 are similarly provided, and are to couple with or connect to respective right and left side anchor straps 312, 314. FIG. 11*b* also shows toe prong anchor 317 for retaining toe prong 315 within a hole (not shown) of sole 310. In this particular embodiment, toe prong anchor 317 is shaped as a heart, but any shape or texture may be provided, and it is contemplated that different designs may be removably coupled with sole 310. Additionally heel 330 coupled with sole 310 is shown.

Figure 13:
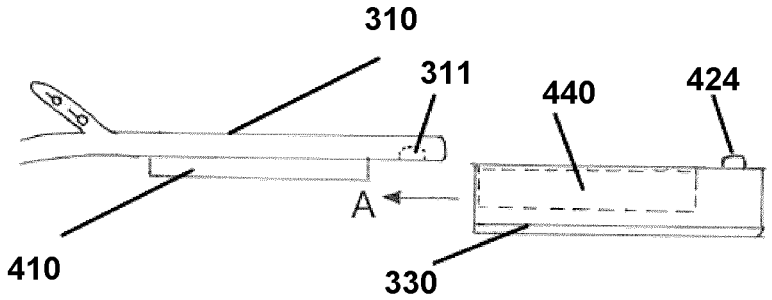
FIG. 13 is a side elevation view of the shoe of FIG. 11*a*, with the detachable heel element of FIG. 12.
Figure 12:
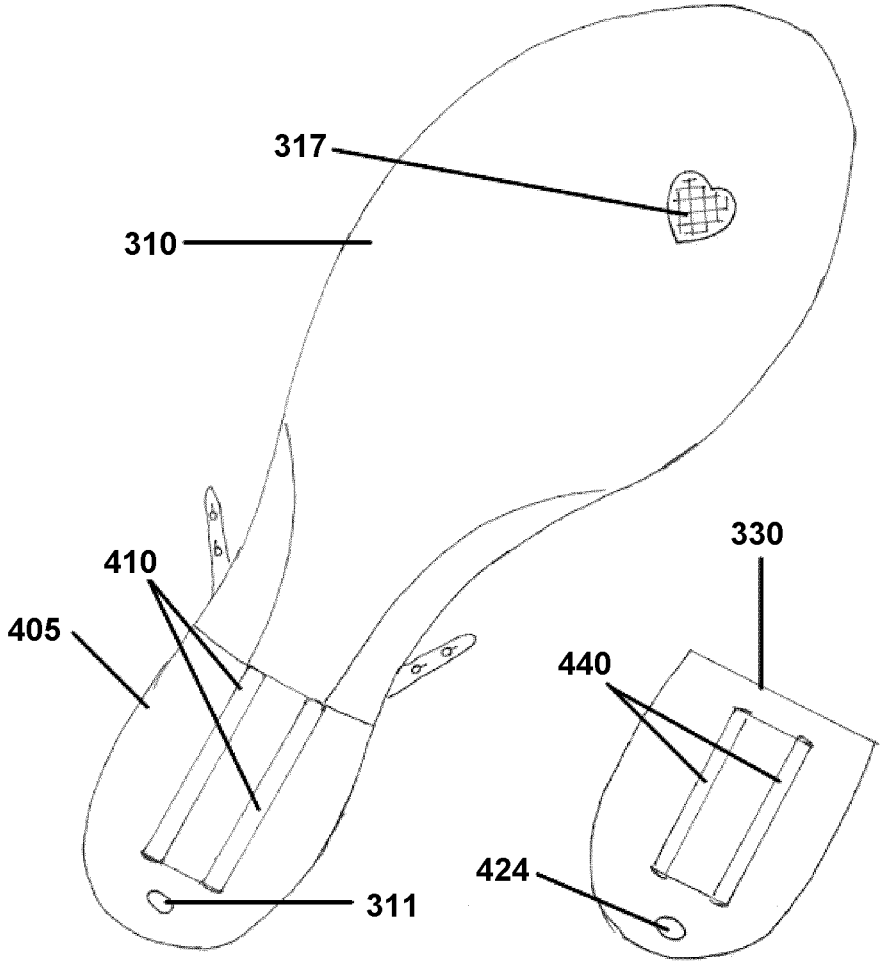
FIG. 12 is a bottom view of the shoe of FIG. 11*a*, with detachable heel elements.

Referring next to FIGS. 12 and 13, shoe 300 is shown with heel 330 removed therefrom. As is shown, sole section 405 includes one or more retaining members 410. In this particular embodiment of the invention, retaining members 410 comprise two sliding members. Heel portion 330 preferably includes corresponding mating recesses 440. Of course, recesses may be provided on sole section 405 with corresponding retaining members being provided on heel 330. In one embodiment, as is shown in FIG. 13, heel portion 330 is preferably moved in the direction indicated by Arrow A relative to sole 310 so that retaining members 410 are received by corresponding mating recesses 440. Once fully engaged, a mating protrusion 424 of heel portion 330 is received by recess 311 defined by sole section 405 of sole 310, thus providing a positive engagement and retaining the heel in the coupled position.

Figure 14:
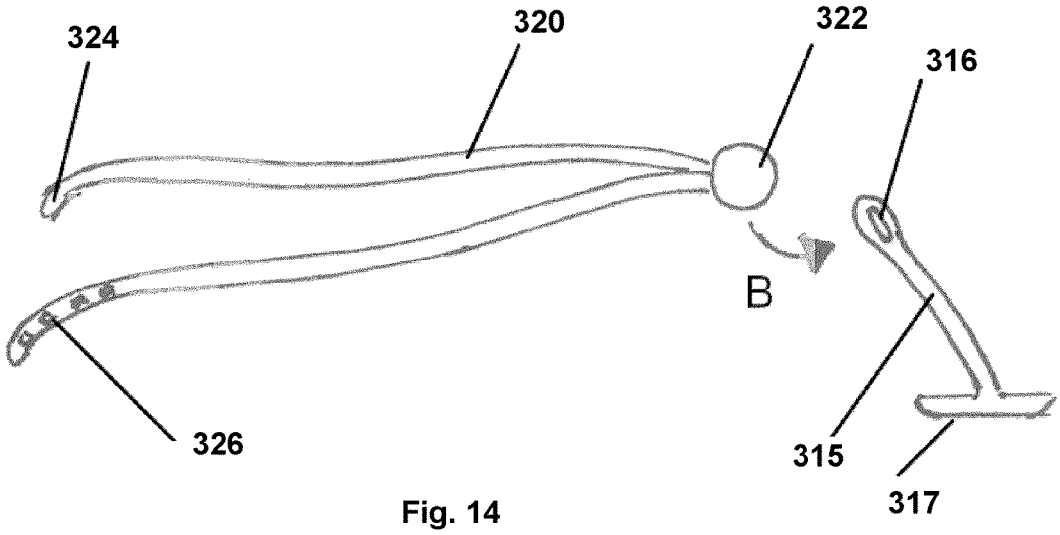
FIG. 14 depicts the toe prong and foot housing strap of FIG. 11*a;*

FIG. 14 depicts toe prong 315 and foot housing strap 320 including foot housing strap coupler 322. As is further shown in FIGS. 14 and 15, toe prong 315 may be first inserted through sole 310 at hole 510 710 defined thereby so that toe prong anchor 317 is preferably retained within recess 512, also defined by sole 310. Then foot housing strap coupler 322 may be placed through toe prong coupler 316. Foot housing strap coupler 322 is preferably inserted through toe prong coupler 316 defined by toe prong 315 by moving foot housing strap coupler 322 in the direction indicated by Arrow B relative to toe prong 315 and toe prong coupler 316 defined thereby. Of course, toe prong may be inserted through sole 310 after foot housing strap coupler 322 is inserted through toe prong coupler 316 either by passing the entire combination through hole 510, or by providing toe prong anchor in a manner that allows for its insertion through hole 510 from a top side of sole 310, and then retention within recess 512.

Figure 15:
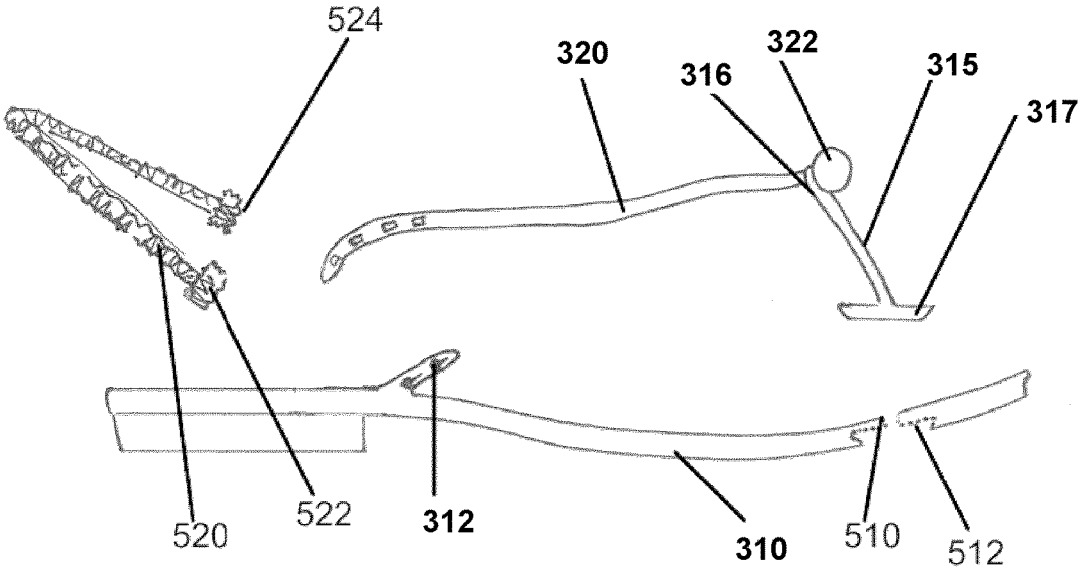
FIG. 15 depicts the components of FIG. 14, and further includes a sole and heel strap in accordance with an embodiment of the disclosure.

Further shown in FIG. 15 is a heel strap 520, further including right and left coupling sleeves 522, 524. Each coupling sleeve is adapted to fit along corresponding portions 326, 324 of foot housing strap 320 before the coupling of portions 326, 324 of foot housing strap 320 to corresponding right and left side anchor straps 312, 314.

Figure 16:
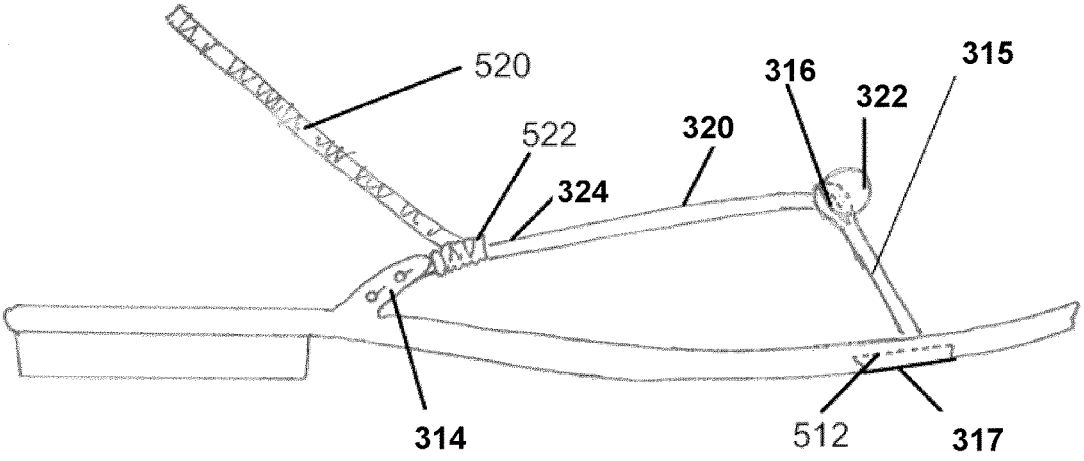
FIG. 16 is a side elevation view of the shoe of FIG. 11*a*, with the assembled components depicted in FIGS. 14 and 15.

FIG. 16 depicts a constructed sandal in accordance with an embodiment of the invention. As is shown in FIG. 16, toe prong anchor 317 is retained within recess 512, foot housing strap coupler 322 is retained by toe prong coupler 316, and coupling sleeves 522 (and 524 not shown in FIG. 16) are retained by corresponding right and left foot housing strap anchors 326, 324. These foot housing strap anchors are respectively coupled with right and left side anchor straps 312, 314 (not shown in FIG. 16).

Figure 17:
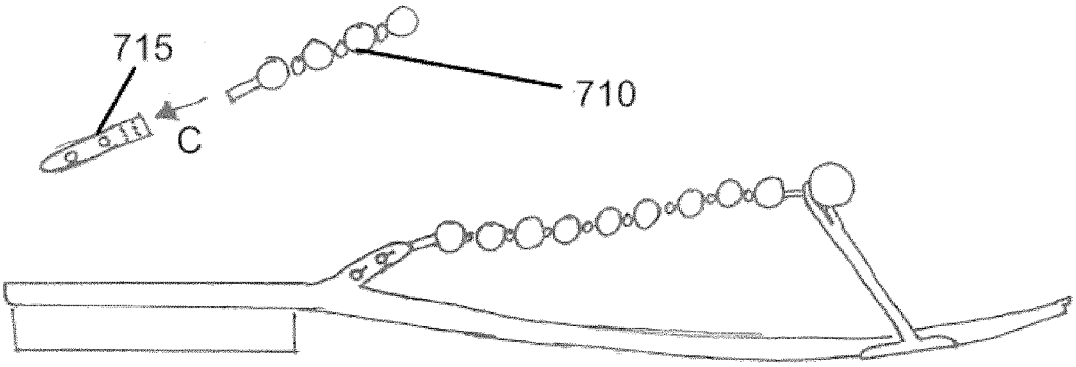
FIG. 17 is a side elevation view of the shoe of FIG. 11*a*, with an alternative design of the foot housing strap.

FIG. 17 depicts an alternative embodiment of the disclosure in which right and left foot housing strap anchors are preferably formed of an ornamental portion 710 and an anchor portion 715. In this particular ornamental portion 710 is moved in the direction of Arrow C to couple with anchor portion 715. Once coupled, this combination preferably operates similarly to foot housing strap 120 as described above.

Figure 18:
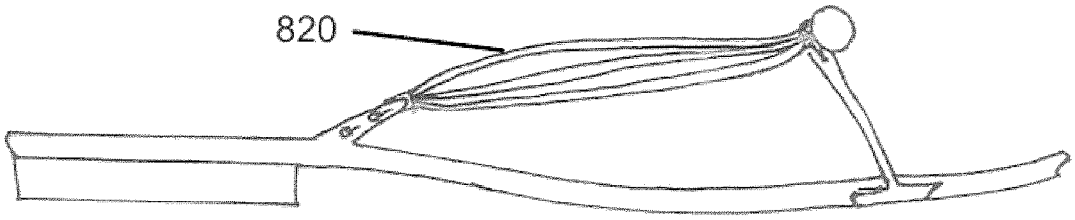
FIG. 18 is a side elevation view of the shoe of FIG. 11*a*, with a second alternative design of the foot housing strap.

FIG. 18 depicts an alternative embodiment of the disclosure where housing strap 820 is provided a number of strands rather than a single unitary structure.

Figure 19:
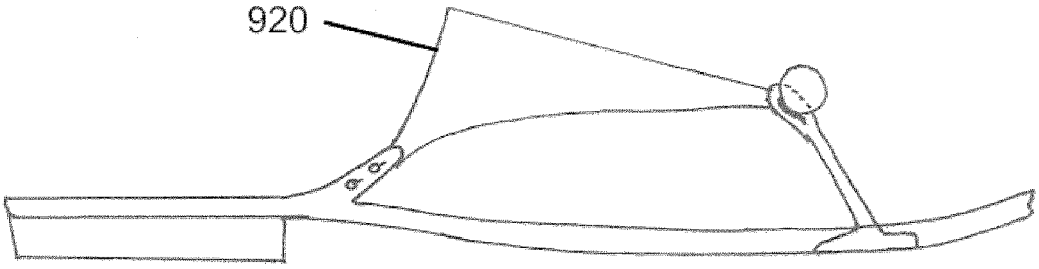
FIG. 19 is a side elevation view of the shoe of FIG. 11*a*, with a third alternative design of the foot housing strap.

FIG. 19 depicts a further alternative embodiment of the invention where housing strap 920 is provided as a surface providing structure above the foot of a wearer of the sandal.

Figures 20A, 20B:
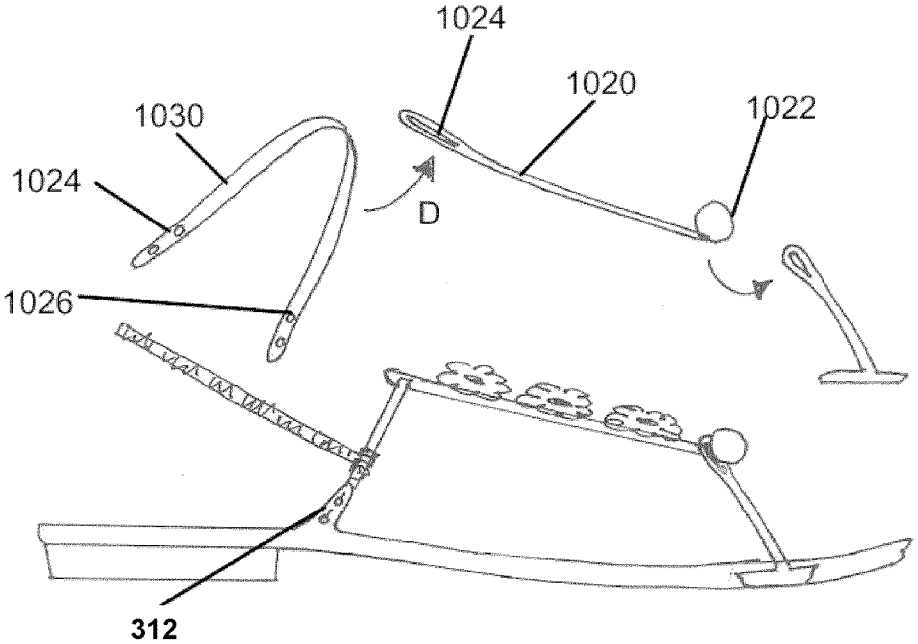
FIG. 20*a* is a side elevation view of the shoe of FIG. 11*a*, with a fourth alternative design of the foot housing strap, and further including a heel strap.
FIG. 20*b* is an exploded view of the toe strap, foot housing strap, and heel strap of FIG. 20*a*.

Referring next to FIGS. 20*a* and 20*b*, an additional alternative embodiment of the disclosure is shown. In this depicted embodiment previously presented housing strap 320 may alternatively be provided as a single housing strap 1020 3020 and a split housing strap 1030. Single housing strap 1020 preferably defines a hole 1024 therein adapted to receive split housing strap 1030 therethrough. Housing strap coupler 1022 operates similarly to coupler 322 described above. Furthermore, split housing 1030 includes right and left foot housing strap anchors 1026, 1024 are similarly provided, and are to couple with respective right and left side anchor straps 312, 314. In this manner, additional flexibility may be provided for design of the various embodiment of the invention.

In any of the embodiments of FIGS. 10*a*-20*b*, the materials shown can be the same as those described above for the analogous components of shoe 100. The components can also be made or processed in the same way.

In accordance with any of the described embodiments of the invention, additional ornamentation may be provided on any of the components of the described shoes. These components may be provided of any desired material. Additionally, while the heels of the shoes described above are shown as flat elements, a higher heel may alternatively be provided to provide any type of desired look. Furthermore, while a sliding mechanism is shown for attaching the heel portion, other coupling schemes may be employed to properly retain the heel relative to the sole of the sandal or shoe. On the top side of the sole, functional or decorative interchangeable heel and "ball of the foot" pads or cushions may be provided, allowing for the choice of a number of designs, fabrics, trims and colors.

While the present disclosure has been described with reference to one or more particular embodiments, it will be understood by those skilled in the art that various changes may be made and equivalents may be substituted for elements thereof without departing from the scope thereof. In addition, many modifications may be made to adapt a particular situation or material to the teachings of the disclosure without departing from the scope thereof. Therefore, it is intended that the disclosure not be limited to the particular embodiment(s) disclosed as the best mode contemplated for carrying out this disclosure.

What is claimed is:

1. A modular shoe assembly, comprising:

a sole comprising a front end, a heel end, a top surface, and a bottom surface; and a heel connected to the bottom surface of the sole, at the heel end;

wherein the heel further comprises:

a base, the base having a heel upper surface connected to the bottom surface of the sole, a heel bottom surface on an opposite side of the base from the upper surface, a front, a back, and lateral sides; and a heel band removably connected to the base, wherein the heel band surrounds the back and lateral sides of the base, wherein the heel band has two ends, and a rib on an interior surface of the heel band at each end, so that when the heel band is connected to the base, each of the ribs engage and wrap around the base at the front, and the ends of the heel band are flush with the front of the heel base, and wherein each of the base and the heel band are made of plastic.

2. The shoe assembly of claim 1, wherein the heel band is horseshoe-shaped, and the base of the heel has a shape generally conforming to the heel band, at a point of connection between the two.

3. The shoe assembly of claim 1, wherein the heel band has a third rib projecting from an interior surface thereof, wherein the third rib mates with a corresponding recess in the back of the base.

4. The shoe assembly of claim 1, further comprising a tread covering the heel bottom surface.

5. The shoe assembly of claim 1, wherein the heel band has a decoration on an exterior surface thereof.

6. The shoe assembly of claim 1, wherein at least one of the base and the heel band are injection molded.

7. The shoe assembly of claim 5, wherein the decoration is selected from the group consisting of an embossment, pattern, bead, stone, and any combination thereof.

8. The shoe assembly of claim 1, wherein the front of the heel has a cut-out section where the perpendicular ribs engage the front of the base of the heel.

9. The shoe assembly of claim 4, wherein the heel band is flush with the tread when connected to the base of the heel.

10. A modular shoe assembly, comprising:

a sole comprising a front end, a heel end, a top surface, and a bottom surface;

a routed heel connected to the bottom surface of the sole at the heel end, wherein the routed heel comprises:

a base, the base having a heel upper surface connected to the bottom surface of the sole, a heel bottom surface on an opposite side of the base from the upper surface, a front, a back, and lateral sides; and a heel band removably connected to the base, wherein the heel band surrounds the back and lateral sides of the base; and a tread covering the heel bottom surface, wherein the front, the back, and the lateral sides of the base have routed edges, so that when the heel band is connected to the base, the heel band is flush with the tread, and wherein the heel band has two ends, and a rib on an interior surface of the heel band at each end, so that each of the ribs engage and wrap around the base at the front, and the ends of the heel band are flush with the front of the heel base.

11. The shoe assembly of claim 10, wherein each of the base and the heel band are made of plastic.

12. The shoe assembly of claim 10, wherein the heel band is horseshoe-shaped, and the base of the routed heel has a shape generally conforming to the heel band, at a point of connection between the two.

13. The shoe assembly of claim 10, wherein the heel band has a third rib projecting from an interior surface thereof, wherein the third rib mates with a corresponding recess in the back of the base.

14. The shoe assembly of claim 10, wherein the heel band has a decoration on an exterior surface thereof.

15. The shoe assembly of claim 14, wherein the decoration is selected from the group consisting of an embossment, pattern, bead, stone, and any combination thereof.

16. The shoe assembly of claim 10, wherein at least one of the base and the heel band are injection molded.

17. The shoe assembly of claim 1, wherein the heel band engages the front of the base with a snap fit.

18. The shoe assembly of claim 10, wherein the heel band engages the front of the base with a snap fit.

* * * * *